United States Patent [19]

Galbreath

[11] 4,205,713

[45] Jun. 3, 1980

[54] HINGE AND ROLLER

[75] Inventor: Gerald W. Galbreath, Marion, Ohio

[73] Assignee: Overhead Door Corporation, Dallas, Tex.

[21] Appl. No.: 908,052

[22] Filed: May 22, 1978

[51] Int. Cl.[2] ..... E05D 15/20

[52] U.S. Cl. ..... 160/201

[58] Field of Search ..... 160/201, 209, 168, 323–328

[56] References Cited

U.S. PATENT DOCUMENTS

| | | | |
|---|---|---|---|
| 2,015,478 | 9/1935 | Kiesling | 160/209 |
| 2,322,088 | 6/1943 | Black | 160/201 |
| 2,525,309 | 10/1950 | Norberg | 160/209 |
| 2,926,728 | 3/1960 | Johannsen et al. | 160/209 |
| 3,605,852 | 9/1971 | Vecchiarelli | 160/168 |
| 4,009,745 | 3/1977 | Erpenbeck | 160/326 |

*Primary Examiner*—Peter M. Caun

*Attorney, Agent, or Firm*—Blanchard, Flynn, Thiel, Boutell & Tanis

[57] ABSTRACT

A roller-hinge unit for a sectional door supported on a pair of tracks, wherein opposed hinge halves on adjacent door panels are joined together by a hinge tube which is constructed of a plastic material and is snapped into position to thereby hingedly connect the two hinge halves together. The hinge tube has a flange at one end and a pair of opposed resiliently deflectable fingers at the other end which, when the tube passes through the hinge halves, snap outwardly to axially hold the two hinge halves and the tube in an axially constrained relationship. A track-engaging roller is mounted on one end of an elongated roller stem which is axially slidably received within the plastic hinge tube so that the roller can undergo at least limited axial movement relative to the hinge halves to compensate for variations in the width between the tracks. The roller is preferably provided with a urethane tread.

6 Claims, 8 Drawing Figures

FIG. 3
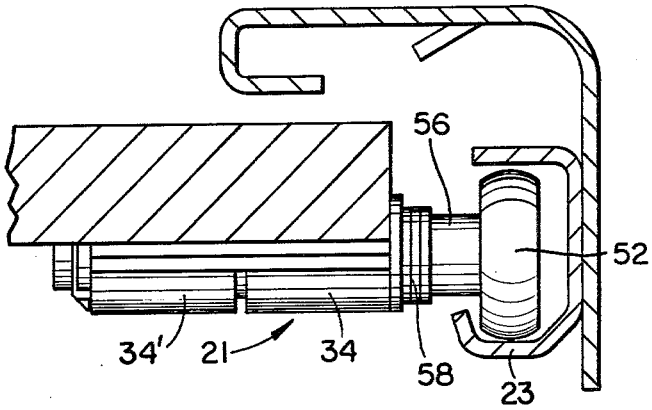
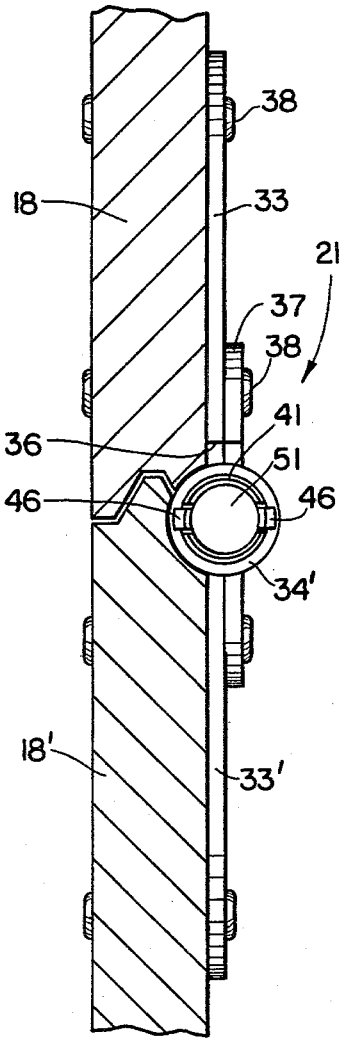
FIG. 4
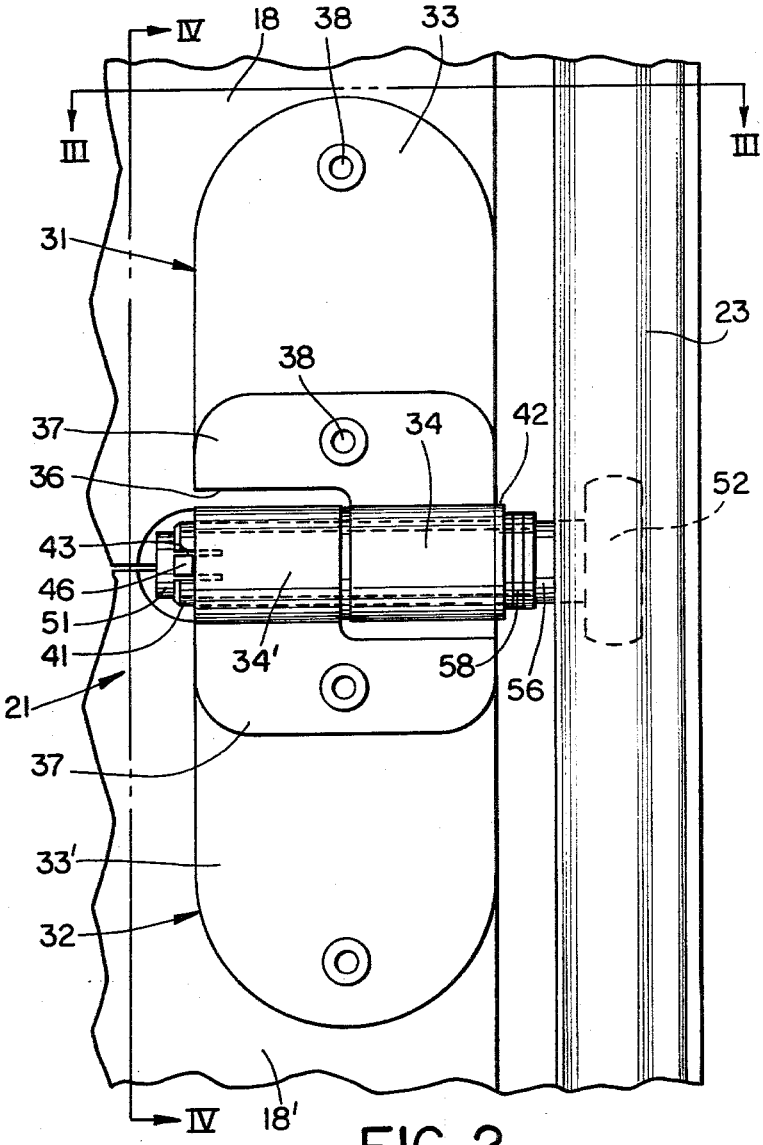
FIG. 2

HINGE AND ROLLER

FIELD OF THE INVENTION

This invention relates to an improved roller-hinge unit for an upwardly acting sectional door, such as for use on a truck trailer.

BACKGROUND OF THE INVENTION

Truck doors of the type commonly referred to as roll-up or upwardly-acting types conventionally employ a plurality of door sections which are hinged together, with the door being rollingly supported on a pair of L-shaped tracks for permitting the door to move upwardly from a substantially vertical closed position into a substantially horizontal opened position. To permit this opening and closing movement, the door is provided with a plurality of roller-hinge units disposed adjacent the side edges of the door, which units not only hinge the adjacent door sections for permitting relative pivoting movement therebetween, but additionally support a roller which is rollingly engaged with and supported by the stationary L-shaped track. The roller-hinge unit conventionally employs a pair of hinge halves fixed to the adjacent door sections and disposed in opposed relationship, which hinge halves support a metal hinge tube in which a metal roller stem is axially floatably received so as to compensate for track variations. This roller stem in turn has a metal roller on the outer end thereof disposed for rolling engagement with the adjacent metal track. While large numbers of these roller-hinge units have operated satisfactorily for many years, nevertheless these known units have possessed features which have been less than optimum.

For example, the rolling of the roller on the track is undesirably noisy due to the metal-to-metal contact therebetween. Additional noise is also caused by the metal-to-metal contact between the hinge tube and the hinge halves pivotally supported thereon.

In an attempt to improve upon the known roller-hinge unit of the above-described type, particularly so as to minimize the noise, there has also been developed and utilized a roller-hinge unit employing a plastic roller provided with a rubber tire, with the roller being mounted on a metal roller stem which is press fit within the hinge tube. While this unit has been observed to reduce the noise, nevertheless this unit has possessed disadvantages. For example, in this unit the roller and stem are axially restrained relative to the hinge tube due to the press fit of the latter within the hinge halves. This makes it necessary to maintain precise tolerances with respect to the manufacture and assembly of the track, and particularly with respect to the mounting of the track relative to the door opening. Any misalignment or variation in the width between the tracks causes the roller to be sidewardly slidably displaced, causing rapid wear of the roller tread so as to result in the roller having a very short life expectancy.

A further problem associated with the known roller-hinge units is the looseness in the overall hinge connection, which looseness results from the large diametral clearance between the hinge tube and the hinge parts as stationarily mounted on the adjacent door sections. The known roller-hinge units have necessarily required substantial diametral clearance to permit the door to be manufactured with acceptable and achievable tolerance levels, and at the same time compensate for the substantial tolerances and variations which occur in the structure of the truck body and of the stationary tracks mounted thereon. These clearances have necessarily resulted in substantial looseness between adjacent door sections which further increase the noise generated by the unit during door operation, and additionally accelerates the wear of the cooperating parts.

It is thus an object of the present invention to provide an improved roller-hinge unit which substantially minimizes, if not eliminates, most of the above-mentioned disadvantages while at the same time permitting the door and the roller-hinge unit to be manufactured with practical and economical tolerances.

A further object is to provide an improved roller-hinge unit, as aforesaid, which utilizes a hinge tube constructed of a stiff plastic material, which hinge tube can be snapped into the cooperating hinge parts on the door section to provide a tighter hinged connection between the door sections, and at the same time provide a quiet slidable connection between the hinge tube and the roller stem which permits the latter to axially, and even rotatably, move relative to the hinge tube.

Still a further object is to provide a roller-hinge unit, as aforesaid, wherein the roller utilizes a tire tread constructed of polyurethane so as to greatly reduce the noise resulting from rolling engagement with the track, while at the same time providing the roller with maximum wear and durability.

It is also an object to provide a roller-hinge unit, as aforesaid, which can be manufactured and assembled efficiently and economically, which permits the door and the stationary track structure to possess maximum dimensional variations and tolerances while at the same time permitting proper compensation for these variations and tolerances, and which provides a highly durable and substantially quieter operation.

Other objects and purposes of the invention will be apparent to persons familiar with structures of this type upon reading the following specification and inspecting the accompanying drawings.

BRIEF DESCRIPTION OF THE DRAWINGS

FIG. 2 is an enlarged, fragmentary elevational view illustrating the roller-hinge unit.

FIG. 3 is a sectional view taken along line III—III in FIG. 2.

FIG. 4 is a sectional view taken along line IV—IV in FIG. 2.

Figure 1:
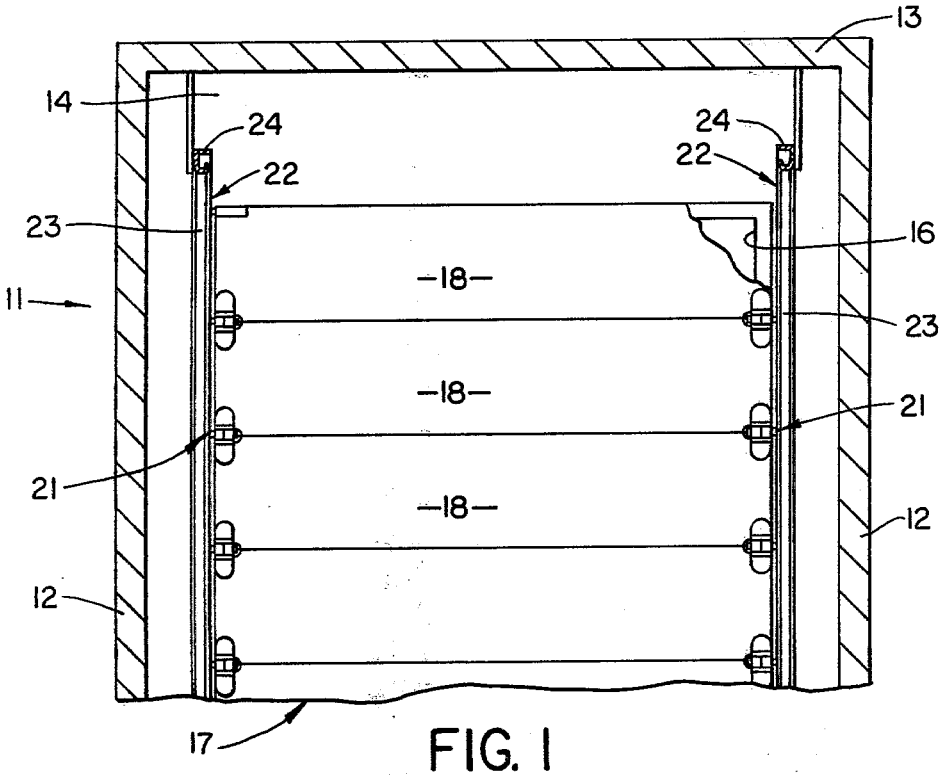
FIG. 1 is an elevational view illustrating the interior side of a truck door.

Certain terminology will be used in the following description for convenience in reference only and will not be limiting. For example, the words "upwardly," "downwardly," "rightwardly" and "leftwardly" will designate directions in the drawings to which reference is made. The words "inwardly" and "outwardly" will refer to directions toward and away from, respectively, the geometric center of the door and designated parts thereof. Said terminology will include derivatives of the above words, and words of similar import.

SUMMARY OF THE INVENTION

The objects and purposes of this invention, including those mentioned above, are met by providing a roller-hinge unit wherein the opposed hinge halves on adjacent door sections are joined together by a hinge tube which is constructed of a plastic material and is snapped into position to thereby securely hingedly connect the two hinge halves together. The hinge tube has a flange at one end and a pair of opposed resiliently deflectable fingers at the other end which, when the tube passes through the hinge halves, snap outwardly to axially hold the two hinge halves and the tube in an axially constrained relationship. A track-engaging roller is mounted on one end of an elongated roller stem which is axially slidably received within the plastic hinge tube so that the roller can undergo at least limited axial movement relative to the hinge halves to compensate for variations in the width between the tracks. The roller is preferably provided with a urethane tread.

DETAILED DESCRIPTION

FIG. 1 illustrates a portion of a conventional truck trailer 11 which includes opposed sidewalls 12 interconnected by a top wall 13 and having a rear wall 14 containing a conventional door opening 16 therein. A movable door 17 is disposed for closing the opening 16 in a conventional manner. The door 17 is of the sectional type and includes a plurality of panels or sections 18 hingedly connected together by hinges 19 in a conventional manner. The door 17 is additionally provided, adjacent its side edges, with roller-hinge units 21 which not only hingedly join the adjacent door sections, but also rollingly support the door on a pair of spaced and substantially parallel L-shaped tracks 22. The tracks 22 include vertical track sections 23 which are fixed to the rear wall 14 on opposite sides of the opening 16 for holding the door 17 in a substantially vertical position wherein it closes the opening. These vertical track sections 23 in turn have the upper ends thereof joined through intermediate arcuate track sections to the horizontal track sections 24 which extend into the interior of the truck and are fixedly positioned adjacent the top wall 13. The door, by being rollingly supported on the L-shaped tracks 22, can thus be rollingly moved between a vertical position for closing the opening 16, as indicated in FIG. 1, into an open horizontal position wherein the door is supported substantially on and between the horizontal track sections 24.

The structure of the door 17 and of the guide tracks 22 associated therewith, as briefly described, is conventional and further description of same is not believed necessary.

Considering now the roller-hinge unit 21, and referring specifically to FIGS. 2–4, same includes a pair of known identical hinge halves or parts 31 and 32 fixed to adjacent door panels designated 18 and 18' in FIG. 2. The hinge part 31 includes a mounting plate 33 which overlies the door panel 18 and is fixed to a sleeve portion 34 at its one edge. A further platelike flange 37 is fixed to the sleeve portion 34 and disposed in overlying relationship to the mounting plate 33. The hinge part 31 has a cutout or notch 36 which extends approximately one-half the width of the hinge part and is disposed in alignment with the sleeve portion 34 so that the latter thus extends over approximately one-half the width of the respective hinge part. Appropriate fasteners 38, such as rivets, fixedly secure the hinge part 31 to the door panel 18.

The other hinge part 32 is identical to the part 31 described above, so that corresponding parts thereof have been identified by the same reference numerals but with the addition of a prime (') thereto.

The hinge parts 31 and 32 are fixedly connected to the respective door panels 18 and 18' so as to be in opposed relationship whereby the sleeve portion 34 on one hinge half is positioned within the cutout 36' on the other hinge half, whereby the sleeve portions 34 and 34' are disposed in axially aligned relationship, which aligned relationship extends along the joint or interface between the adjacent door panels 18 and 18'.

The hinge parts 31 and 32 are hingedly joined together by a hinge tube 41 which extends axially through and is snugly but rotatably received within the aligned sleeve portions 34 and 34'. The hinge tube 41 is formed of a stiff plastic material, such as Celcon, and has a radially outwardly projecting annular flange 42 at one end thereof, which flange is adapted to abut the exposed end of the sleeve portion 34. The other end of hinge tube 41 is provided with a pair of substantially parallel slots 43 formed therein, which slots extend axially inwardly from the free end of the tube and are uniformly spaced on opposite sides of the diametrical plane, whereby each slot thus extends through the tube sidewall at opposed locations. These slots 43 define therebetween a pair of diametrically opposed, cantilevered fingers 44 which extend axially at the free end of the tube. Each of these fingers 44 terminates in a locking tab 46 which is disposed directly adjacent the free end of the respective finger and projects radially outwardly beyond the periphery of the hinge tube. The locking tab 46 terminates in a rearward stop surface 47, and is additionally provided with a tapered cam surface 48 formed thereon which slopes outwardly and rearwardly away from the free end of the tube. The free end of the tube is also provided with an annular beveled surface 49 which, in conjunction with the tapered cam surfaces 48, facilitate entry of the tube into the aligned sleeve portions 34 and 34'.

The diameter of the hinge tube 41 is preferably slightly smaller, such as approximately six thousandths of an inch, than the interior of the sleeve portions 34 and 34' so that the hinge tube will be snugly received within the sleeve portions yet be rotatable relative thereto. When the hinge tube is inserted through the sleeve portions, the fingers 44 possess sufficient resiliency as to be deflected inwardly due to the engagement of the cam surfaces 48 with the interior wall of the sleeve portions. When the hinge tube 41 has been inserted completely through the sleeve portions 34 and 34' so that the flange 42 abuts the outer edge of the sleeve portion 34, then the locking tabs 46 are likewise disposed adjacent the exposed end of the other sleeve portion 34' so that the fingers 44 resiliently move radially outwardly to their original position, whereby the locking tabs overlap the end of sleeve portion 34' so that stop surface 47 is thus disposed closely adjacent the exposed end of this latter sleeve portion. The hinge tube 41 is thus axially fixed relative to the hinge parts 31 and 32, and the hinge parts are similarly axially fixedly connected but are permitted to relatively hinge with respect to one another about a horizontal hinge axis defined by the longitudinally extending axis of the tube 41.

Figure 7:
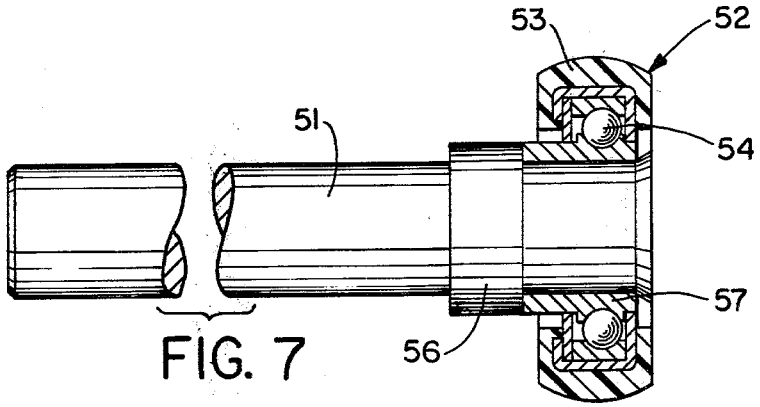
FIG. 7 is a view, partially in cross section, of the roller and its support stem.

The hinge tube 41 freely rotatably and axially slidably supports therein a roller stem or shaft 51, which shaft in turn has a track-engaging roller 52 mounted on the outer end thereof. As shown in FIG. 7, the roller 52 is preferably formed with an outer annular tire 53 molded of a synthetic elastomer, such as polyurethane, with the tire being rotatably supported by an intermediate antifriction bearing 54 of conventional construction. The shaft 51 includes an enlarged annular hub portion 56 disposed intermediate thereof, which hub portion forms a shoulder against which the inner bearing race 57 abuts. The shoulder 56 also functions as an abutment for bearing against the hinge tube flange 42 when the roller stem is inserted into the hinge tube 41 or, alternately, appropriate annular spacers or washers 58 can be positioned between the hinge tube flange 42 and the hub portion 56 as necessary so as to result in proper positioning of the roller 52 within the track 22.

Figure 8:
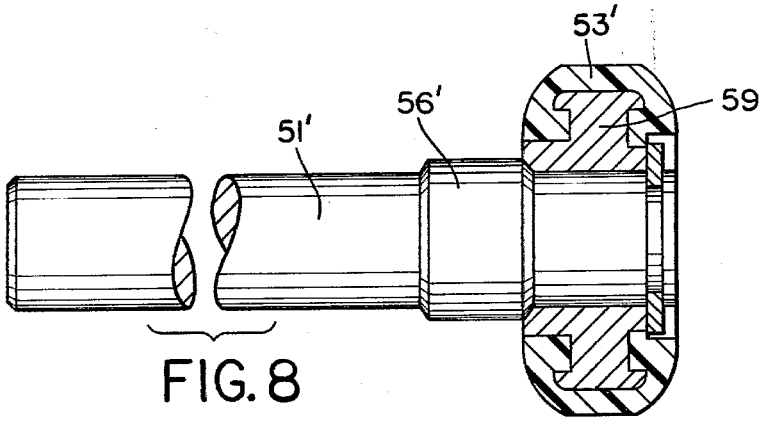
FIG. 8 is a view similar to FIG. 7 but illustrating a modification of the roller.
Figure 5:
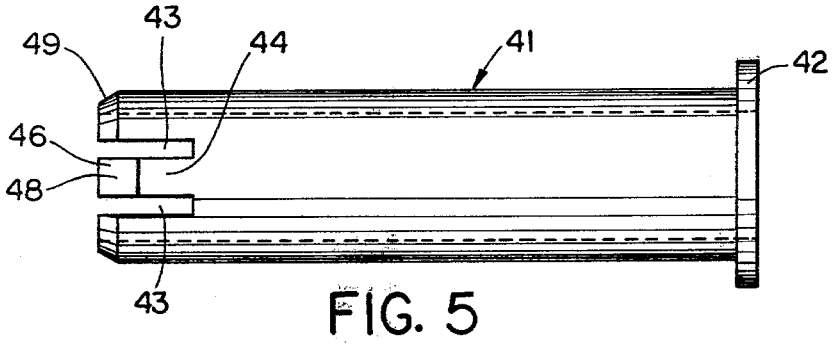
FIG. 5 is an enlarged, elevational view of the hinge tube.
Figure 6:
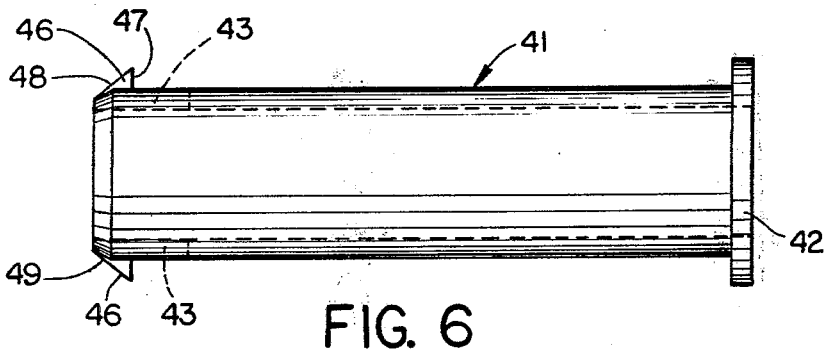
FIG. 6 is a plan view of the hinge tube shown in FIG. 5.

In the event that an antifriction bearing is not deemed necessary or desired, then the roller can be formed as illustrated in FIG. 8, whereupon the annular polyurethane tire 53 is molded directly around an annular insert 59 which rotatably surrounds the free end of the roller stem and abuts against the hub 56. Insert 59 is formed of a suitable low-friction material, such as Nylatron, so as to function as a journal bearing for the roller.

The roller tire 53 is preferably molded from polyurethane since such a roller has been observed to possess extreme durability and resistance to grease and the like, so as to thereby provide the roller with maximum wear and life. At the same time, the engagement of this roller with the metal track results in extremely quiet operation while still providing for the desired free movement of the door inasmuch as such a roller still possesses minimal rolling friction at its point of engagement with the track.

OPERATION

During movement of the door between the opened and closed positions, in which positions the door is disposed in vertical and horizontal positions respectively, the adjacent door panels 18 and 18' are swingably moved with respect to one another, which swingable movement occurs about the axis of the hinge tube 41. This relative hinging or swinging between the door panels is permitted due to the permissible relative rotation of the sleeve portions 34 and 34' with respect to the hinge tube 41. Since the hinge tube 41 is of a stiff plastic material, whereas the hinge halves are normally constructed of metal, this thus provides for a tight yet quiet hinging of the adjacent door panels. At the same time, the door movement results in rolling displacement of the roller 52 along the L-shaped track 22, which rolling is also extremely quiet in view of the engagement between the urethane tire 53 and the metal track 22. The rolling of the tire 53 is permitted by the presence of the antifriction bearing 54 or journal bearing 58. If necessary, the complete roller stem 51 can rotate within the plastic hinge tube 41.

Since the roller stem 51 is not axially restrained relative to the hinge 41, the stem 51 can be pulled axially outwardly (rightwardly in FIG. 2) at least a limited amount so as to compensate for any misalignment or variation in the spacing between the pair of parallel tracks 22. For example, if the opposed tracks possess a small degree of divergence, then the roller 52 will remain in proper engagement within the track as illustrated in FIG. 3 since the slidable mounting of the roller stem within the tube 41 permits the roller to move axially away from the adjacent edge of the door. In this manner, the roller will always remain in proper engagement within the track even though such variations and misalignments do occur. This permissible axial floating of the roller permits even greater amounts of variation or misalignment in the width or spacing between the tracks, thereby simplifying the initial manufacture and assembly of the structure, while resulting in a more durable and quieter operation than was obtainable with the prior structures.

The hinge tube 41 is preferably molded in one piece of a hard plastic material which possesses limited elasticity to permit formation of the resilient locking fingers 44. The plastic material selected for the hinge tube should preferably have not only stiffness and dimensional stability, but also lubricity to thereby provide a desirable bearing for the hinge halves. Numerous plastics, such as thermoplastics of the type termed acetal, possess these desirable properties and would be suitable for use in forming the hinge tube.

It is also contemplated that the axis of the roller shaft could be parallel with, but transversely offset from, the hinge axis between adjacent door panels. This type of structure, as disclosed in U.S. Pat. No. 1,974,147, could still use the improved plastic tube 41 of this invention in surrounding relation to the roller shaft, and also in conjunction with the knuckle-type hinge, so as to result in many of the above-described advantages, including minimal wear and quiet operation.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a vehicle body comprising walls defining an enclosure and providing an access opening into the interior of the enclosure, track means disposed adjacent the access opening and extending inwardly from the access opening into the interior of the enclosure, an articulated door movably supported on said track means for movement between closed and opened positions, said door including a plurality of hingedly connected door panels, and a plurality of roller-hinge units mounted on the door for permitting pivotal movement between adjacent door panels and for permitting the door to be rollingly supported on the track means for movement between said opened and closed positions, the improvement wherein said roller-hinge unit comprises:

a hinge including a pair of pivotally connected hinge parts associated with a pair of adjacent door panels for permitting pivotal movement therebetween, each of said hinge parts being fixedly connected to a respective one of said door panels, each said hinge part having an elongated cylindrical sleeve portion, and the sleeve portions of said pair of hinge parts being positioned axially adjacent and in substantial alignment with one another;

tube means mounted on said hinge parts for hingedly connecting said parts together for relative rotational displacement therebetween about the longitudinal axis of said tube means, said tube means comprising an elongated one-piece hinge tube which extends axially through and supports said sleeve portions for permitting relative rotational movement therebetween, said hinge tube being constructed of a hard plastic material for minimizing noise generated by said roller-hinge unit, said hinge tube including lock means for creating a snap-type engagement with said hinge parts to axially lock said tube thereto and cam means for automatically causing said lock means to be moved radially inwardly into a nonlocking position when said hinge tube is being axially slidably inserted through the aligned sleeve portions;

a roller shaft having an axially elongated stem portion projecting into and axially slidably supported within said hinge tube, said roller shaft also having a projecting shaft portion which extends outwardly beyond said hinge tube; and a roller mounted on said projecting shaft portion and being disposed in rolling engagement with said track, said roller having an annular tire tread constructed of a synthetic elastomer for minimizing noise.

2. A vehicle body according to claim 1, wherein said tube has a radially outwardly projecting annular flange defining a stop surface at one end thereof for limiting insertion of said tube into said hinge, the lock means on said tube including an axially elongated resilient finger adjacent the other end of said tube, said finger at the free end thereof having a radially outwardly projecting tab which defines a radially outwardly projecting stop surface, said sleeve portions being axially secured between said stop surfaces, and said cam means comprising an outer cam surface formed on said tab, said cam surface tapering radially inwardly as it extends axially toward the free end of said finger.

3. A vehicle body according to claim 1, wherein said hinge tube has a pair of axially extending resilient fingers integrally associated therewith and disposed adjacent one end thereof, the free ends of said fingers terminating in radially projecting tabs each having an outer sloped camming surface thereon, whereby insertion of said tube through said aligned sleeve portions causes said camming surfaces to engage the interior of said sleeve portions and deflect said locking fingers inwardly until said tabs pass through said sleeve portions whereby the locking fingers resiliently deflect outwardly so that said tabs radially overlap one end of said aligned sleeve portions, said tube having a radial projection fixed thereon adjacent the other end thereof for radially overlapping the other end of said aligned sleeve portions for axially securing said aligned sleeve portions in surrounding relationship to said tube.

4. A vehicle body according to claim 3, wherein said hinge parts are identical.

5. In an upwardly-acting articulated door for closing a vertical opening, said door including at least two panels disposed for relative pivotal movement about a substantially horizontal hinge axis, a pair of substantially parallel L-shaped tracks disposed adjacent the opposite sides of said door for guiding the movement of said door between opened and closed positions, and a pair of roller-hinge units disposed adjacent the opposite side edges of said door for hingedly connecting the adjacent door panels together, said roller-hinge units also rolling supporting said door on said tracks, the improvement wherein said roller-hinge unit comprises:

a pair of cooperating hinge halves each being fixedly mounted on a respective one of said door panels, said hinge halves each having a cylindrical sleeve portion, said hinge halves being disposed in opposed relationship so that the sleeve portions thereof are positioned in axially adjacent and aligned relationship;

a one-piece plastic hinge tube extending axially through the aligned sleeve portions, said sleeve portions being disposed in surrounding relationship to and rotatably supported on said hinge tube for permitting relative pivoting between said adjacent door panels, said hinge tube having means integrally associated therewith for axially fixing said adjacent sleeve portions and said hinge tube axially together to prevent relative axial separation therebetween;

said axial fixing means as associated with said hinge tube comprising radially outwardly projecting tabs disposed adjacent the opposite free ends of said hinge tube and disposed for radially overlapping the opposite axial ends of said aligned sleeve portions for axially confining the latter therebetween, the tabs adjacent the opposite ends of said tube defining opposed stop surfaces which project radially outwardly and axially confine said sleeve portions therebetween, the tab adjacent at least one end of said hinge tube being resilient and having a tapered cam surface extending axially from the respective stop surface toward the adjacent free end of the tube so that said last-mentioned tab is cammed radially inwardly as said hinge tube is slidably inserted through said sleeve portions with said tab then being resiliently snapped radially outwardly into a locking position;

roller means mounted on said hinge tube and disposed in rolling engagement with the adjacent track, said roller means including a roller shaft having a support portion adjacent one end thereof and an axially elongated stem portion adjacent the other end thereof, said stem portion being snugly and axially slidably supported within said hinge tube, and a roller mounted on said support shaft portion and being disposed in rolling engagement with said track, said roller including an annular tread constructed of a synthetic resin.

6. In an upwardly-acting articulated door for closing a vertical opening, said door including at least two panels disposed for relative pivotal movement about a substantially horizontal hinge axis, a pair of substantially parallel L-shaped tracks disposed adjacent the opposite sides of said door for guiding the movement of said door between opened and closed positions, and a pair of roller-hinge units disposed adjacent the opposite side edges of said door for hingedly connecting the adjacent door panels together, said roller-hinge units also rolling supporting said door on said tracks, the improvement wherein said roller-hinge unit comprises:

a pair of cooperating hinge halves each being fixedly mounted on a respective one of said door panels, said hinge halves each having a cylindrical sleeve portion, said hinge halves being disposed in opposed relationship so that the sleeve portions thereof are positioned in axially adjacent and aligned relationship;

a one-piece plastic hinge tube extending axially through the aligned sleeve portions, said sleeve portions being disposed in surrounding relationship to and rotatably supported on said hinge tube for permitting relative pivoting between said adjacent door panels, said hinge tube having means integrally associated therewith for axially fixing said adjacent sleeve portions and said hinge tube axially together to prevent relative axial separation therebetween;

said axial fixing means as associated with said hinge tube comprising radially outwardly projecting tabs disposed adjacent the opposite free ends of said hinge tube and disposed for radially overlapping the opposite axial ends of said aligned sleeve portions for axially confining the latter therebetween, the tabs adjacent the opposite ends of said tube defining opposed stop surfaces which project radially outwardly and axially confine said sleeve portions therebetween, the plastic hinge tube adjacent one end thereof having a portion on which is provided one of said tabs, said last mentioned portion being sufficiently resilient so that said last mentioned tab can be radially moved inwardly so that the one end of said hinge tube can be slidably inserted through said sleeve portions with said last mentioned tab then being resiliently snapped radially outwardly into a locking position;

roller means mounted on said hinge tube and disposed in rolling engagement with the adjacent track, said roller means including a roller shaft having a support portion adjacent one end thereof and an axially elongated stem portion adjacent the other end thereof, said stem portion being snugly and axially slidably supported within said hinge tube, and a roller mounted on said support shaft portion and being disposed in rolling engagement with said track, said roller including an annular tread constructed of a synthetic resin.

* * * * *